United States Patent [19]

Stana et al.

[11] 4,397,820

[45] Aug. 9, 1983

[54] METHOD TO MAINTAIN A HIGH $FE^{+2}/FE^{+3}$ RATIO IN THE STRIPPING SYSTEM FOR THE RECOVERY OF URANIUM FROM WET PROCESS PHOSPHORIC ACID

[75] Inventors: Regis R. Stana; José G. Lopez, both of Lakeland, Fla.

[73] Assignee: Wyoming Mineral Corporation, Lakewood, Colo.

[21] Appl. No.: 171,699

[22] Filed: Jul. 24, 1980

[51] Int. Cl.[3] ..... C01G 43/00

[52] U.S. Cl. ..... 423/8; 423/10

[58] Field of Search ..... 423/8, 10

[56] References Cited

U.S. PATENT DOCUMENTS

| | | | |
|---|---|---|---|
| 2,859,092 | 11/1958 | Bailes et al. | 423/10 |
| 3,711,591 | 1/1973 | Hurst et al. | 423/10 |
| 3,737,513 | 6/1973 | Wiewiorowski et al. | 423/8 |
| 4,002,716 | 1/1977 | Sundar | 423/10 |
| 4,241,027 | 12/1980 | Bowerman et al. | 423/8 |

FOREIGN PATENT DOCUMENTS

| | | | |
|---|---|---|---|
| 8552 | 5/1980 | European Pat. Off. | 423/8 |

*Primary Examiner*—Edward A. Miller

*Attorney, Agent, or Firm*—D. P. Cillo

[57] ABSTRACT

A process to maintain a high iron +2/iron +3 concentration in the reductive stripping system for recovering uranium from wet-process phosphoric acid, comprises contacting partially oxidized strip acid, containing substantial amounts of iron +3, which had just previously stripped uranium values from an organic solvent, with elemental iron to reduce iron +3 to iron +2 and provide a $Fe^{+2}/Fe^{o}$ conversion ratio of from about 1.5 to 3.0.

2 Claims, 3 Drawing Figures

METHOD TO MAINTAIN A HIGH $FE^{+2}/FE^{+3}$ RATIO IN THE STRIPPING SYSTEM FOR THE RECOVERY OF URANIUM FROM WET PROCESS PHOSPHORIC ACID

BACKGROUND OF THE INVENTION

Uranium can be recovered from commercial grade wet process phosphoric acid by an extraction-reductive stripping process. In this process, phosphoric acid solution is contacted, generally in a multistage, counter-current extractor, with an organic extractant solvent composition having an affinity for uranium values. After extraction, two phases are formed, namely an aqueous acid raffinate phase and an organic phase rich in uranium values. Then, the organic phase is stripped of its uranium content, generally in a multistage countercurrent reductive stripper, and the stripped organic solvent is returned to the extraction system.

This stripping is accomplished by reducing the uranium to the +4 state with a reduced strip acid solution containing a high concentration of ferrous iron, +2 state, in phosphoric acid. Heretofore, elemental iron has only been added to the aqueous acid raffinate in a separate reduction means, to increase ferrous iron concentration, before the strip acid solution is fed to the reductive stripper, as taught by Hurst et al., in U.S. Pat. No. 3,711,591, and Sundar, in U.S. Pat. No. 4,002,716. In the reduction means of these processes, the following primary reaction occurs: $Fe^o+2H^+=Fe^{+2}+H_2$.

In the process of reducing the uranium in the stripper, the iron +2 in the strip acid is oxidized to ferric iron, +3 stage. Additional iron +2 is also oxidized to iron +3 by any oxidant that is carried over with the extractant solvent and by any air that it contacts. The presence of iron +3 in the stripper from these various sources can reduce the ability of the strip acid solution to remove uranium in the strip step. Iron +3 can also precipitate as either $Fe_3NaH_8(PO_4)_6$, $Fe_3KH_8(PO_4)_6$ or $Fe_3(NH_4)H_8(PO_4)_6$, depending on the availability of sodium, potassium or ammonium ions. Thus, in order to maximize operation and control of the reductive stripper, the $Fe^{+2}$ concentration must be maximized.

SUMMARY OF THE INVENTION

The above problems have been solved and the above need met, by contact reacting partially oxidized strip acid formed in the stripper, and containing substantial amounts of iron +3 after stripping, with elemental iron to reduce iron +3 to iron +2. In one embodiment of the invention, the elemental iron can be added to at least one reductive stripper in granular or powder form, having a particle size between about 100 and about 3 mesh. In the preferred embodiment, a major portion of partially oxidized strip acid, from at least one reductive stripper, will be circulated through at least one elemental iron containing reactor, and then returned to the stripper; where the recirculation process is an integral part of the stripper system. The strip acid can be derived from first or second cycle acid raffinate.

Direct elemental iron reaction with iron +3 in the reductive stripper system increases the iron +2 utilization. This provides a total $Fe^{+2}/Fe^o$ conversion ratio for the oxidized acid in the stripper system of from about 1.5 to 3.0, i.e., most of the iron +3 present in and transferred to the partially oxidized strip acid is reduced. Maintaining a high iron +2 concentration, directly in the reductive stripper system, results in a better strip coefficient, better product quality, more stable operation, and minimal solids precipitation.

BRIEF DESCRIPTION OF THE DRAWINGS

For a better understanding of the invention, reference may be made to the preferred embodiments exemplary of the invention, shown in the accompanying drawings, in which.

DESCRIPTION OF THE PREFERRED EMBODIMENT

Figure 1:
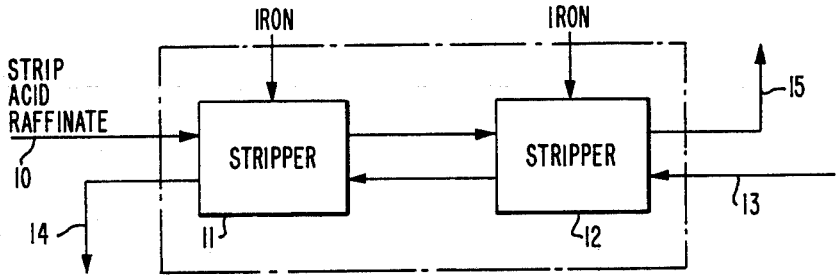
FIG. 1 shows in detail, one embodiment of this invention where ground elemental iron is added to each reductive stripper.

In the first cycle of the uranium recovery process, the wet-process phosphoric acid feed is clarified and fed into a multistage extraction system. The feed is typically a hot aqueous solution of phosphoric acid having a pH of about 0 to about 1 and containing about 0.1 to about 0.5 gram/liter of uranium, as the uranyl ion, $UO_2^{+2}$, and about 7 to about 15 grams/liter of ferric iron. In the extractor the feed acid is mixed with a water-immiscible, organic solvent containing a reagent which reacts with the uranyl ions to form a complex soluble in the solvent. Typically, the solvent is kerosense in a 0.1 to 10 feed acid to solvent ratio, by volume, and it contains about 0.1 to 1 mole/liter of di-2-ethylhexyl phosphoric acid (D2EHPA) and about 0.025 to about 0.25 mole/liter of tri-n-octyl phosphine oxide (TOPO).

The organic phase, rich in uranium values but contaminated with minor amounts of iron +3 ions, passes to a reductive stripper system. A portion of the aqueous acid raffinate from the extractor can be reduced and passed to the reductive stripper. This reduced acid can be used to strip uranium from the organic solvent, and in the process it becomes partially oxidized. The partially oxidized strip acid is then subject to transfer of iron +3 to it from various sources in the stripper system. Thus, the partially oxidized acid contains substantial amounts of iron +3 after stripping. Elemental iron is then contacted with the iron +3 present in and transferred to the partially oxidized strip acid in the reductive stripper system.

By this direct contact, the elemental iron reacts primarily with ferric iron, +3 state, i.e., about 80% to 90% of the elemental iron reacts with iron +3, by the following reaction $Fe^o+2Fe^{+3}=3Fe^{+2}$. The following secondary reaction also occurs: $Fe^o+2H^+=Fe^{+2}+H_2$. Acid raffinate is also produced in the extraction process of the second cycle of uranium recovery, as is well known. This raffinate can be reduced and used to strip uranium in the stripping system of this invention. This second cycle of uranium recovery involves various extracting and stripping operations, and is detailed completely in U.S. Pat. No. 4,002,716, herein incorporated by reference. Throughout the specification the term "elemental iron" is meant to be iron that contains at least about 85% of $Fe^o$, and less than about 5% of total $Fe^{+2}$ and $Fe^{+3}$.

In the prior art method of reduction of raffinate acid solely in a separate reduction means outside the stripper, the following primary reaction occurs: $Fe^o+2H^+=Fe^{+2}+H_2$. Thus, in this invention, the added elemental iron can be as much as 3 times more effective than the prior art method, since each mole of elemental iron results in the production of three moles of iron +2. Since there is competition in the stripper system between the primary and secondary reactions, the achieved effectiveness is usually less than 3 times, but is generally at least 1.5 and more likely about 2.5 times more effective in providing iron +2 than the prior art methods, i.e., the total $Fe^{+2}/Fe^o$ conversion ratio for the oxidized acid in the stripper system can usually reach 2.5.

A simple material balance for an iron bed reactor will provide an illustration of how to calculate the $Fe^{+2}/Fe^o$ ratio. If recycle strip acid into the iron bed reactor contains on analysis 10 grams/liter $Fe^{+2}$ and 15 grams/liter total iron ($Fe^{+2}$ and $Fe^{+3}$), and after contact with $Fe^o$ in the reactor exits with an analysis of 12.5 grams/liter $Fe^{+2}$ and 16 grams/liter total iron; the ratio $Fe^{+2}/Fe^o=(12.5-10)/(16-15)=2.5/1=2.5$. The iron +3 is present in the stripper system from a variety of sources, including ferric iron impurities contained in the elemental iron and the organic phase fed into the stripper, ferric iron oxidized by air, ferric iron oxidized by other oxidants carried over with the organic phase and as oxidized ferrous iron resulting from reducing the uranium. A major portion of this iron +3 will be present in the partially oxidized strip acid after the stripping operation.

Referring now to FIG. 1 of the drawings, first or second cycle acid raffinate from line 10 is fed into a stripper system, enclosed by dashed lines, containing a first stripper 11. The acid raffinate in this embodiment is previously reduced by elemental iron in a reducer, not shown. Elemental iron is fed into stripper 11 to react directly with iron +3 present in and transferred to the partially oxidized strip acid formed in the stripper. Similarly, elemental iron is fed into second stripper 12 to react directly with iron +3 present in and transferred to the partially oxidized strip acid formed in the stripper. Thus, the primary reaction in the strippers between the iron components is $Fe^o+2Fe^{+3}=3Fe^{+2}$. The organic phase rich in uranium values and containing iron +3 impurities from line 13 is fed through strippers 12 and 11 counter-current to the strip acid. Stripped organic solvent in line 14 is then fed back into the extraction system, while product acid containing concentrated uranium values in line 15 is fed into the second cycle of the uranium recovery process.

The elemental iron powder added to the strippers has a critical particle size range between about 149 microns diameter (100 mesh) and about 6.7 millimeters diameter (3 mesh), preferably between 354 microns diameter (42 mesh) and 2.8 millimeters diameter (7 mesh). Particle sizes less than 149 microns tend to react too fast with the acid and can be easily carried over with the organic stream. Particle sizes greater than 6.7 millimeters will react too slowly with the acid, tend to settle in the acid in stagnant areas where they can quickly consume the available iron +3 and only react with the $H^+$ present.

Figure 2:
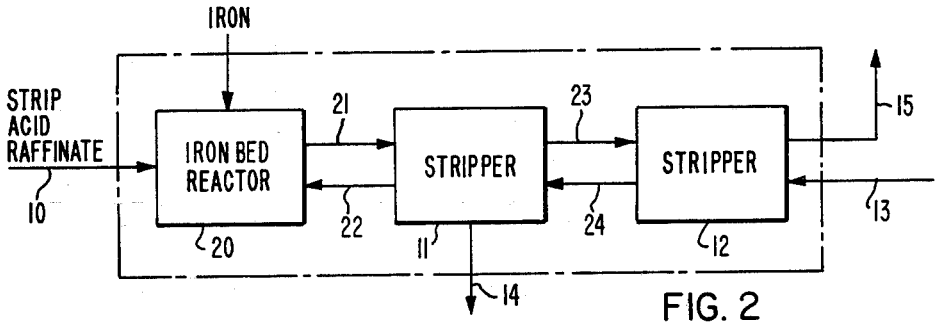
FIG. 2 shows in detail, one embodiment of this invention where partially oxidized strip acid from one reductive stripper is circulated through an elemental iron bed reactor and returned to the stripper.

Referring to FIG. 2 of the drawings, showing a second embodiment of the invention, first or second cycle acid raffinate from line 10, which need not be previously reduced, is fed into a stripper system, enclosed by dashed lines, containing at least one elemental iron containing reactor 20. The reduced strip acid in line 21, containing a high concentration of iron +2, is fed into stripper 11. The partially oxidized strip acid formed in stripper 11 is split into a circulating stream and an advance stream. The circulating stream is then recirculated through the iron containing reactor 20 via line 22, where the iron +3 present in and transferred to the partially oxidized acid has another chance to be reduced to iron +2.

Preferably, the acid from line 22 is circulated through the elemental iron in reactor 20 at a high flow rate effective to assure good contact of the iron +3 with the elemental iron surface. The advance strip stream is then fed by line 23 into second stripper 12, while the organic phase from line 13 is advanced by line 24 into stripper 11.

It is critical that the rate of circulation of partially oxidized strip acid via line 22 be between about 5 to about 30 times by volume the rate of strip acid advance through line 23, i.e., the volume ratio of the circulating stream:advance stream is from about 5 to about 30:1. Thus, the primary reaction in the iron bed reactor is $Fe^o+2Fe^{+3}=3Fe^{+2}$, i.e., direct elemental iron reaction with iron +3, where the iron +3 is present from a variety of sources. Less than 5 times recirculation over advance, acid will reduce the effectiveness of the invention by allowing a build-up of iron +3 in the stripper 11. Over 30 times recirculation over advance, acid will not significantly further reduce the iron +3 in the stripper 11 and can cause pumping problems in the system.

Stripped organic solvent in line 14 is then fed back into the extraction system, while product acid containing concentrated uranium values in line 15 is fed into the second cycle of the uranium recovery process. While it would be a duplicate step, the acid raffinate could be reduced outside the stripper system and then be fed directly to stripper 11, with subsequent recirculation of the partially oxidized acid through the elemental iron containing reactor.

Figure 3:
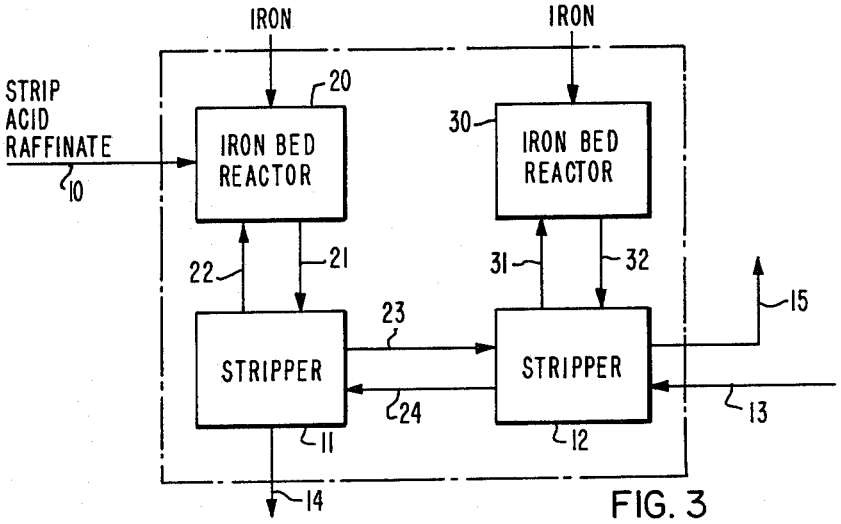
FIG. 3 shows in detail, one embodiment of this invention where partially oxidized strip acid from two reductive strippers is circulated through each stripper's associated elemental iron bed reactor and returned to the stripper.

Referring now to FIG. 3 of the drawings, showing a third embodiment of the invention, a modification of the system of FIG. 2 is shown, where each stripper has its own associated elemental iron containing reactor. Here, first or second cycle acid raffinate from line 10, which need not be previously reduced, is fed into a stripper system, enclosed by dashed lines, containing an elemental iron containing reactor 20. The reduced strip acid in line 21, containing a high concentration of iron +2, is fed into stripper 11. The partially oxidized strip acid formed in stripper 11 is split into a circulating stream and an advanced stream. The circulating stream is then recirculated through the iron containing reactor 20 via line 22, where the iron +3 present in and transferred to the partially oxidized acid has another chance to be reduced to iron +2. The advance strip stream is then fed by line 23 into second stripper 12, while the organic phase from line 13 is advanced by line 24 into stripper 11.

Partially oxidized strip acid formed in stripper 12 is split into a circulating stream and an advance stream. The circulating stream is then recirculated through the second iron containing reactor 30 via line 31, where the iron +3 present in and transferred to the partially oxidized acid has another chance to be reduced to iron +2. The reduced strip acid containing a high concentration of iron +2 is fed into stripper 12 via line 32. Preferably the acid from lines 22 and 31 is circulated through the elemental iron in reactors 20 and 30 at a high flow rate effective to assure good contact of the iron +3 with the elemental iron surface.

Similar to the system of FIG. 2, it is critical that the rate of circulation of partially oxidized strip acid via lines 22 and 31 must be between about 5 to about 30 times by volume the rate of strip acid advance through line 23, i.e., the volume ratio of the circulating stream:advance stream is from about 5 to about 30:1. Thus, the primary reaction in each iron bed reactor is $Fe^{o}+2Fe^{+3}=3Fe^{+2}$, i.e., direct elemental iron reaction with iron +3, where the iron +3 is present from a variety of sources. Stripped organic solvent in line 14 is then fed back into the extraction system, while the advance stream product acid containing concentrated uranium values in line 15 is fed into the second cycle of the uranium recovery process. The process of FIG. 3, utilizing an iron bed reactor associated with each stripper is the most preferred embodiment of the invention. In all the embodiments of this invention, up to 3 times less elemental iron addition is required to provide adequate iron +2 concentration than in prior art methods where raffinate was reduced solely before the stripping operation. This provides a substantial cost savings.

EXAMPLE 1

In an operation similar to that shown in FIG. 1 of the drawings, hot, commercial grade, wet-process, aqueous, phosphoric acid (30% $P_2O_5$; sp. gr.=1.36), containing about 0.2 gram/liter of uranium and about 10 grams/liter of iron was clarified and fed into an extractor. In the extractor, uranium values were extracted into a water-immiscible, organic extractant solvent composition containing 0.5 mole of di-2-ethylhexyl phosphoric acid (D2EHPA) and 0.125 mole of tri-n-octylphosphine oxide per 1 liter of kerosine as diluent.

The organic extractant solvent, containing uranium values was passed from the extractor to a reductive stripper system at about 40° C., to allow stripping of uranium values from the solvent into a portion of the acid raffinate. The raffinate was from the first cycle extractor and had been reduced by elemental iron in a reducer. The reduced strip acid entering the first stripper 11 by line 10 contained 12.01 grams/liter of iron +2.

In the first stripper the reduced strip acid contacted the organic phase containing uranium values where part of the iron +2 in the strip acid was oxidized to iron +3 in the process of stripping the uranium values. The partially oxidized acid also had other iron +3 transferred into it and contacted elemental iron, which was fed into the first stripper at the rate of 570 pounds/day. The iron +3 present in and transferred to the partially oxidized acid was reduced by the elemental iron to iron +2. The reduced strip acid then passed the second stripper 12. The reduced strip acid entering the second stripper contained 11.70 grams/liter of iron +2.

In the second stripper the reduced strip acid again contacted the organic phase containing uranium values, fed by line 13, where part of the iron +2 in the strip acid was oxidized to iron +3 in the process of stripping the uranium values. The partially oxidized acid also had other iron +3 transferred into it and contacted elemental iron which was fed into the second stripper at the rate of 915 pounds/day. The iron +3 present in and transferred to the partially oxidized acid was reduced by the elemental iron to iron +2. The acid leaving the second stripper by line 15 to second cycle processing, containing in addition to stripper uranium values, 10.47 grams/liter of iron +2. The stripped organic solvent left the two stage stripping system by line 14.

Since there was ferric iron, +3 state, available in the acid in the strippers, the added elemental iron participated primarily in the following reaction: $Fe^{o}+2Fe^{+3}=3Fe^{+2}$. The total $Fe^{+2}/Fe^{o}$ conversion ratio for the oxidized acid in the stripper system from all iron +3 present was about 2.3. The elemental iron fed into the strippers was ground iron having a particle size range of between 40 mesh and 7 mesh. The elemental iron was totally dissolved before leaving the strippers. The direct addition of iron to the stripper system allowed complete control of the strip circuit since elemental iron could be added immediately to any stripper that did not contain adequate iron +2 with an almost immediate improvement in stripping the uranium from the organic phase. In addition, very minimal precipitation was formed in the strippers.

EXAMPLE 2

In an operation similar to that shown in FIG. 2 of the drawings, hot, commercial grade, wet-process, aqueous, phosphoric acid (30% $P_2O_5$; sp. gr.=1.36), containing about 0.2 gram/liter of uranium and about 10 grams/liter of iron was clarified and fed into an extractor. In the extractor, uranium values were extracted into a water-immiscible, organic extractant solvent composition containing 0.5 mole of di-2-ethylhexyl phosphoric acid (D2EHPA) and 0.125 mole of tri-n-octylphosphine oxide per 1 liter of kerosene as diluent.

The organic extractant solvent containing uranium values was passed from the extractor to a reductive stripper system at about 40° C., to allow stripping of uranium values from the solvent into a portion of the acid raffinate from the first cycle extractor. The acid raffinate was fed directly from the extractor into iron bed reactor 20 by line 10. The iron bed reactor was packed with elemental iron turnings about 0.5" wide by 0.05" thick. The reduced strip acid entering the first stripper 11 by line 21 contained 16.0 grams/liter of iron +2.

In the first stripper the reduced strip acid contacted the organic phase containing uranium values where part of the iron +2 in the strip acid was oxidized to iron +3 in the process of stripping uranium values. The partially oxidized acid, which also had other iron +3 transferred into it, was then split into two streams. About 12 volumes of partially oxidized acid was recycled back into the iron bed reactor by line 22. About 1 volume of partially oxidized strip acid was advanced to the second stripper by line 23. The partially oxidized strip acid in lines 22 and 23 contained about 15.1 grams/liter of iron +2.

In the iron bed reactor, the recirculated partially oxidized acid contacted elemental iron at a flow rate assuring good elemental iron contact. The iron +3 present in and transferred to the partially oxidized acid was reduced by the elemental iron in the iron bed reactor to iron +2. The reduced recirculated strip acid, containing 16.0 grams/liter of iron +2, was then passed back to the first stripper by line 21.

The advanced partially oxidized strip acid fed by line 23 into the second stripper 12 again contacted the organic phase containing uranium values, fed by line 13, where additional iron +2 in the strip acid was oxidized in the process of stripping the uranium values. The acid leaving the second stripper by line 15 to second cycle processing, contained in addition to stripped uranium values, 9.9 grams/liter of iron +2. The stripped organic solvent left the two stage stripping system by line 14.

Since there was ferric iron, +3 state, available in the iron bed reactor, the elemental iron present participated primarily in the following reaction: $Fe^{o}+2Fe^{+3}=3Fe^{+2}$. The total $Fe^{+2}/Fe^{o}$ conversion ratio for the oxidized acid in the stripper system from all iron +3 present was 1.97. Performance of the economically priced iron filings was good despite some oxidation and incomplete dissolution. Very minimal precipitation was formed in the strippers. It is contemplated that addition of a second recycle and a second iron bed reactor, as shown in FIG. 3 of the drawings, would provide a total $Fe^{+2}/Fe^{o}$ conversion ratio of about 2.5 to 2.7.

We claim:

1. In the method of recovering uranium from wet-process phosphoric acid comprising the following steps:

(1) passing acid solution containing uranium through an extractor to provide uranium rich solvent and raffinate acid, (2) contacting part of the raffinate acid with elemental iron to produce reduced acid containing iron +2, and (3) stripping uranium rich solvent with the reduced acid in a reductive stripper system comprising at least one stripper, wherein part of the iron in the acid is oxidized to form partially oxidized acid, said partially oxidized acid containing substantial amounts of iron +3 after stripping; the improvement comprising contacting the iron +3 contained in the partially oxidized acid formed in step (3) with elemental iron powder added directly to at least one stripper of said reductive stripper system, the reduce iron +3 to iron +2.

2. The method of claim 1, wherein the elemental iron power added has a particle size range of between about 354 microns diameter the about 2.8 millimeters diameter, the primary reaction between the iron +3 and the elemental iron power in step (3) is: $Fe^{o}+2Fe^{+3}=3Fe^{+2}$ and the $Fe^{+2}/Fe^{o}$ conversion ratio in step (3) is from about 1.5 to 3.0.

* * * * *